United States Patent [19]

Yamaguchi et al.

[11] Patent Number: 4,505,107

[45] Date of Patent: Mar. 19, 1985

[54] EXHAUST GAS CLEANING APPARATUS

[75] Inventors: Shunzo Yamaguchi, Okazaki; Takeshi Fukazawa, Kariya; Morihiro Atsumi, Toyohashi, all of Japan

[73] Assignee: Nippondenso Co., Ltd., Kariya, Japan

[21] Appl. No.: 436,439

[22] Filed: Oct. 25, 1982

[30] Foreign Application Priority Data

Oct. 26, 1981 [JP] Japan ..... 56-171021
Oct. 26, 1981 [JP] Japan ..... 56-171022

[51] Int. Cl.[3] ..... F01N 3/02

[52] U.S. Cl. ..... 60/303; 60/311; 55/283; 55/466; 55/DIG. 10; 55/DIG. 30

[58] Field of Search ..... 60/300, 303, 311; 219/350, 376, 382; 55/283, 466, DIG. 30, DIG. 10, 282

[56] References Cited

U.S. PATENT DOCUMENTS 4,319,896 3/1982 Sweeney ..... 60/311
4,373,330 2/1983 Stark ..... 60/311
4,427,418 1/1984 Kogiso ..... 60/311

FOREIGN PATENT DOCUMENTS 2756570 9/1978 Fed. Rep. of Germany ..... 60/311

*Primary Examiner*—Douglas Hart
*Attorney, Agent, or Firm*—Cushman, Darby & Cushman

[57] ABSTRACT

In an exhaust gas cleaning apparatus a ceramic heating resistor has a lattice-shaped exhaust gas passage and is formed by extrusion. The ceramic heating resistor is fixed closely to the upper stream side of a filter which catches particulates contained in exhaust gas. This heating resistor is divided into a plurality of sections so that heating current is successively supplied to the divided sections.

14 Claims, 11 Drawing Figures

EXHAUST GAS CLEANING APPARATUS

BACKGROUND OF THE INVENTION

This invention relates to an exhaust gas cleaning apparatus for cleaning exhaust gas from a Diesel engine, more specifically to an exhaust gas cleaning apparatus which cleans exhaust gas from a Diesel engine by catching particulates mainly composed of carbon contained in the exhaust gas.

Exhaust gas from a Diesel engine contains particulates mainly composed of carbon. In order to clean such exhaust gas, the particulates must be removed from the exhaust gas. Conventionally, these particulates are caught and removed by using a filter formed of a ceramic of honeycomb structure or a foam structure in an exhaust system. However, if this filter is set in the exhaust system so that the exhaust gas is passed through the filter, the passage resistance of an exhaust passage will be increased by the particulates caught by the filter to lower the engine output.

As measures to counter these drawbacks, there are proposed cleaning apparatus of three types. In a cleaning apparatus of a first type, the caught particulates are burned by a burner. An apparatus of a second type is set near the exhaust port of the engine so that the particulates are burned by operating the engine under such conditions that exhaust gas from the engine is at a high temperature. In a third type, the particulates are burned by electric heat from an electric heater. The cleaning apparatuses of these types, however, are subject to the following drawbacks.

(a) Burner-type cleaning apparatus:

Requiring a fuel supply system and an ignition system, this cleaning apparatus is inevitably complicated and expensive. Moreover, fuel led into the exhaust system will increase the danger of a fire.

(b) Cleaning apparatus set near engine:

Subject to great vibration and high temperature, this apparatus requires additional mechanical strength. In order to raise the exhaust gas to a high temperature (600° C. to 700° C. or more) required for cleaning and regeneration during normal operation, it is necessary that special operating conditions such as air-fuel ratio be improved and that the injection timing be changed. Thus, the output is lowered, and specific fuel consumption is deteriorated.

(c) Electric heater-type cleaning apparatus:

Having an electric heater integrally built-in, this cleaning apparatus must always heat the particulates to a temperature necessary for regeneration. Accordingly, this apparatus requires a great deal of electric power, exerting a bad influence upon the engine and car system. If a conventional metal wire heater is used as the electric heater, it will readily be corroded by exhaust gas to make the cleaning apparatus limited in durability.

SUMMARY OF THE INVENTION

This invention is contrived in consideration of these circumstances, and is intended to provide an exhaust gas cleaning apparatus which is highly durable, and capable of effectively catching particulates contained in exhaust gas from a Diesel engine, and of safely and securely burning the caught particulates without consuming a lot of electric power or exerting a bad influence upon related equipment.

In an exhaust gas cleaning apparatus according to this invention, a ceramic heating resistor having e.g. a lattice-shaped exhaust gas passage and formed by extrusion is fixed closely to the upstream side of a filter which catches particulates contained in exhaust gas. This heating resistor is divided into a plurality of sections so that heating current is successively supplied to the divided sections.

DETAILED DESCRIPTION OF THE PREFERRED EMBODIMENTS

There will now be described in detail one embodiment of the exhaust gas cleaning apparatus according to the present invention with reference to the accompanying drawings of FIGS. 1 to 4.

Figure 1:
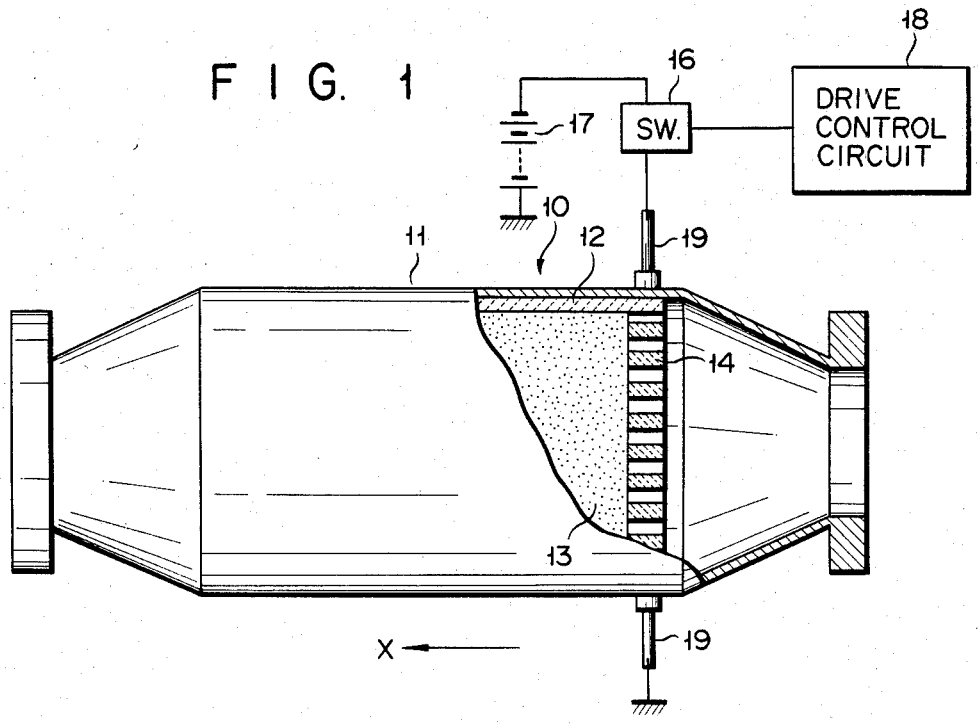
FIG. 1 is a partially broken front view showing one embodiment of the exhaust gas cleaning apparatus according to the present invention.
Figure 2:
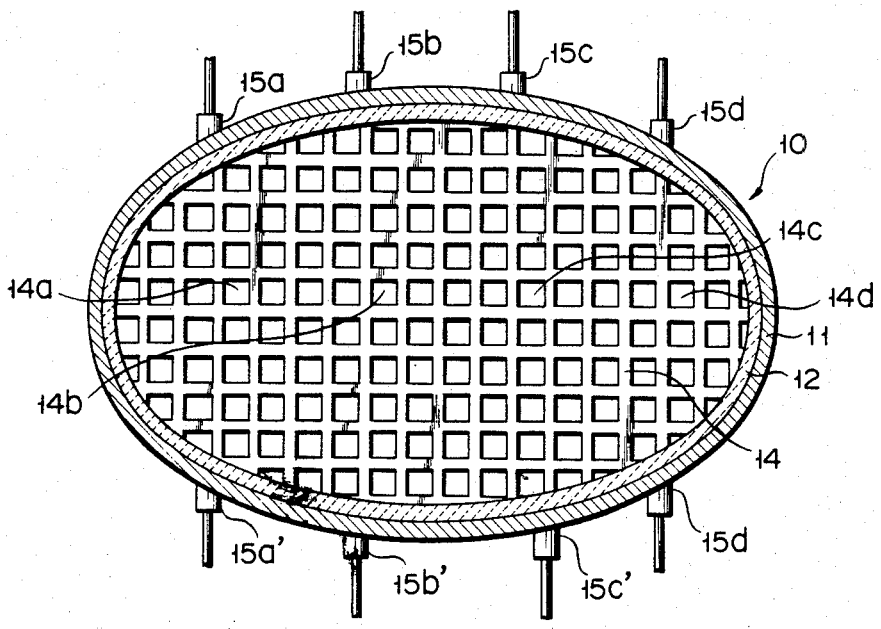
FIG. 2 is a side sectional view of the apparatus shown in FIG. 1.

In FIGS. 1 and 2, numeral 10 designates the exhaust gas cleaning apparatus according to the one embodiment. The exhaust gas cleaning apparatus 10 comprises a barrel-shaped casing 11 of e.g. stainless steel having an elliptic cross section. An adiabatic buffer layer 12 is laid on the inner peripheral surface of the casing 11. The casing 11 is filled with porous ceramic foam, e.g. a cordierite filter 13. The inside space of the casing 11 constitutes part of an exhaust passage (not shown in detail) of a Diesel engine. Exhaust gas from the engine passes through the filter 13 in the casing 11 in the direction indicated by arrow X, and is discharged into the open air. During the discharge, particulates contained in the exhaust gas are caught by the filter 13.

A ceramic heating resistor 14 is fixed to that portion of the inner peripheral surface of the casing 11 which is on the upstream side as viewed along the flowing direction X of the exhaust gas, extending closely in contact with the upstream-side end face of the filter 13. The ceramic heating resistor 14, which is formed by normal extrusion of e.g. SiC or $MoSi_2$, has the form of a lattice to provide satisfactory exhaust gas passages. In this case, the heating resistor 14 is attached to the casing 11 so as to be securely electrically insulated therefrom. As shown in FIG. 2, a plurality of sets of electrodes—four sets of electrodes 15*a* and 15*a*', 15*b* and 15*b*', 15*c* and 15*c*', and 15*d* and 15*d*' in this embodiment—are attached to the outer peripheral wall portion of the ceramic heating resistor 14. Each pair of electrodes 15*a* and 15*a'*, 15*b* and 15*b'*, 15*c* and 15*c'*, or 15*d* and 15*d'* are opposed to each other. The individual pairs of electrodes 15*a* and 15*a'*, 15*b* and 15*b'*, 15*c* and 15*c'*, and 15*d* and 15*d'* divide the heating resistor 14 into four resistor sections 14*a*, 14*b*, 14*c* and 14*d*.

Figure 3:
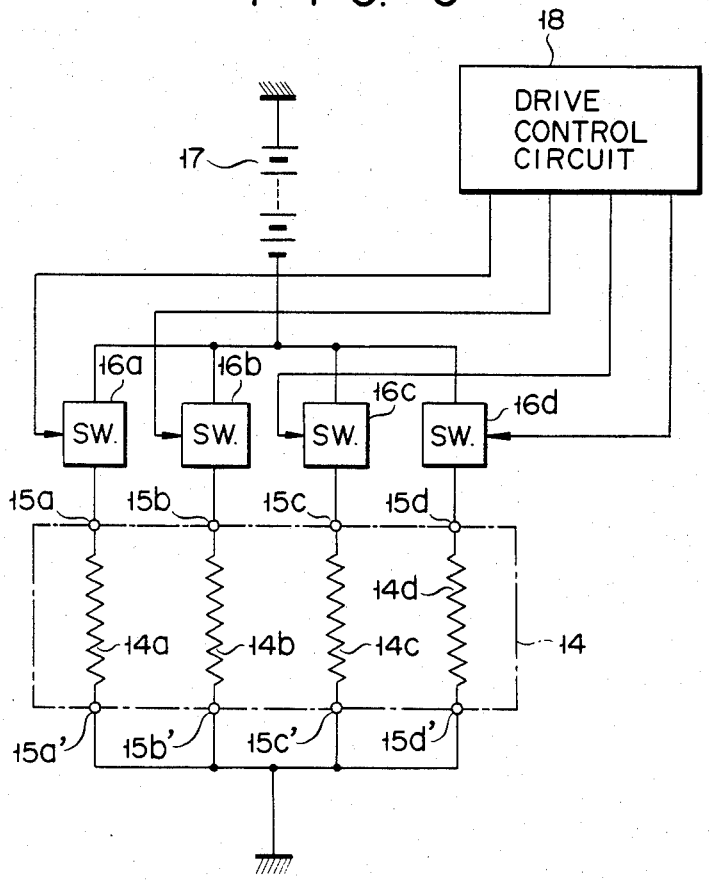
FIG. 3 is a circuit diagram showing a connection arrangement of the apparatus shown in FIG. 1.

As shown in FIG. 3, the electrodes 15*a* to 15*d* are connected to a common power source 17 through control switches 16*a*, 16*b*, 16*c* and 16*d*, respectively. The electrodes 15*a'* to 15*d'* are grounded. The control switches 16*a* to 16*d* are on-off controlled by a drive control circuit 18. When turned on, the control switches 16*a* to 16*d* cause their corresponding resistor sections 14*a* to 14*d* to be heated. Namely, if current is passed between e.g. the electrodes 15*a* and 15*a'*, it flows through the resistor section 14*a* of the heating resistor 14 which is defined between the electrodes 15*a* and 15*a'*. Thus, the heating resistor 14 generates heat only at the resistor section 14*a*.

The control circuit 18 exclusively closes the control switches 16*a* to 16*d* one after another. The respective closing times of the control switches 16*a* to 16*d* closed by the control circuit 18 are so set that the temperatures of their corresponding resistor sections 14*a* to 14*d* reach 600° C. to 1,000° C. within about one minute.

The ceramic heating resistor 14 may alternatively be formed from a mixture of TiC and $Al_2O_3$ as an effective material. An experiment indicates that the specific resistance of the material can be freely determined and satisfactory oxidation resisting property can be obtained by suitably choosing the mixture ratio. In consideration of the particulates sticking to the heating resistor 14 and their combustion at heating regeneration, the coarseness of the lattice structure forming the heating resistor 14 is preferably approximately 25 to 500 meshes per square inch. From a point of view of compactibility and heater characteristic, moreover, the wall thickness and wall depth of the resistor 14 are preferably about 0.2 mm to 1 mm and about 10 mm to 20 mm, respectively.

Experimentally, electric power required for the regeneration is normally 50 W/cm$^2$. Therefore, if the whole heating resistor 14 is energized to be heated at a time, great power will be required, and a large current will pass at once through the resistor 14, thereby exerting a bad influence upon the engine and car system. In the present invention, however, this point is improved since the four sets of electrodes 15*a* and 15*a'*, 15*b* and 15*b'*, . . . divide the heating resistor 14 into the four resistor sections 14*a* to 14*d* so that the resistor sections 14*a* to 14*d* are heated one after another.

Even with this construction, if the electrodes are set in the exhaust gas passages with uncovered condition, it is hard to provide good durability for the electrodes because there is presently no electrode material with both a good oxidation-resisting property and good high-temperature resistance. In this one embodiment, therefore, the electrodes 15*a*, 15*a'*, 15*b*, 15*b'*, . . . are set at the peripheral wall portion so that they cannot easily be subjected to high-temperature exhaust gas. Moreover, the electrodes are securely cut off from the exhaust gas by ceramic or other material.

Figure 4:
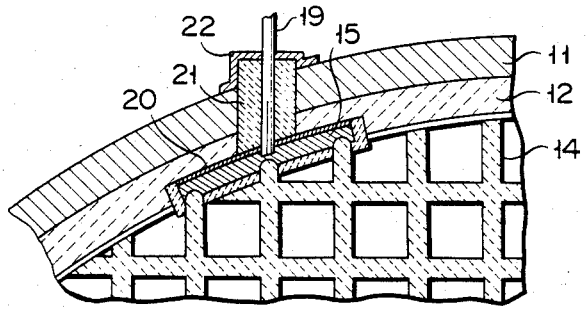
FIG. 4 is an isolated side sectional view showing an electrode of the apparatus shown in FIG. 1.

FIG. 4 shows the construction of an electrode 15 protected against the exhaust gas in the aforementioned mannter. The electrode 15 is representative of the electrodes 15*a*, 15*a'*, 15*b*, 15*b'*, . . . . The electrode 15 is formed by application or vacuum evaporation at that portion of the adiabatic buffer layer 12 which faces the peripheral edge portion of the one resistor section 14*a*, 14*b*, 14*c* or 14*d* of the ceramic heating resistor 14. The electrode 15 is connected with a lead wire 19. The electrode 15 and the lead wire 19 are covered with a ceramic insulator 20. The back side of the electrode 15 may further be covered with a coating material as required. The lead wire 19 is passed through the adiabatic buffer layer 12 and the casing 11 to be led out of the casing 11. The penetrating portion of the lead wire 19 is protected by a porcelain tube 21. Numeral 22 designates a cup for fixing the porcelain tube 21 to the casing 11.

There will now be described the operation of the exhaust gas cleaning apparatus 10 constructed in the aforementioned manner. The exhaust gas cleaning apparatus 10 is attached to an exhaust pipe constituting an exhaust system of the Diesel engine by conventional attaching means. When the Diesel engine is driven, exhaust gas from the engine passed through the exhaust gas cleaning apparatus 10, and particulates in the exhaust gas are caught by the ceramic filter 13. If the quantity of the particulates caught by the filter 13 reaches a predetermined level, then the engine output will be lowered. The drop of the engine output is detected by information such as time, pressure loss, etc., and the exhaust gas cleaning apparatus 10 is started for regenerating operation on the basis of the detection result. That is, electric current is successively passed through the four sets of electrodes 15*a* and 15*a'*, 15*b* and 15*b'*, . . . , so that the resistor sections 14*a*, 14*b*, . . . corresponding to the individual sets of electrodes 15*a* and 15*a'*, 15*b* and 15*b'*, . . . are heated one after another. Thus, the caught particulates are burned to regenerate the cleaning apparatus 10.

In this one embodiment, the ceramic heating resistor is formed integrally so that each resistor section is heated by means of a plurality of electrodes. It is to be understood, however, that the ceramic heating resistor may be divided correspondingly to the individual resistor sections so that supply of electric current is controlled for each division. The way of attaching the electrodes to the heating resistor is not limited to the one embodiment, either. For example, the electrodes may be attached to the peripheral wall portion of the ceramic heating resistor so that it can be taken out without touching either the exhaust gas or the casing. Instead of being lattice-shaped, the ceramic heating resistor may be, for example, honeycomb-shaped.

According to this one embodiment, as described above, the heating resistor comprises a lattice-shaped ceramic heating resistor formed by extruding means. Thus, the resistance against the passage of the exhaust gas can be reduced satisfactorily, and uniform heating resistors can be manufactured with high accuracy. This heating resistor, like the filter, can catch the particulates, and the caught particulates can be burned for effective exhaust gas cleaning. Moreover, the heating resistor is divided into sections, and pairs of electrodes corresponding to these sections are opposed to one another at the peripheral wall portion. Thus, the heating power consumed at a time can be reduced, and the engine and car system can securely be protected against any adverse effects. At the regeneration of the filter by the heating resistor, furthermore, excessive temperature rise can be prevented, so that the electrodes can effectively be protected against the exhaust gas for improved durability.

This invention is not limited to the construction of the aforementioned embodiment, and various changes and modifications may be effected therein by one skilled in the art without departing from the scope or spirit of the invention.

Referring now to FIGS. 5 to 9B, there will be described another embodiment of the exhaust gas cleaning apparatus according to this invention. In the description to follow, like reference numerals are used to designate the same portions as included in the foregoing one embodiment.

Figure 5:
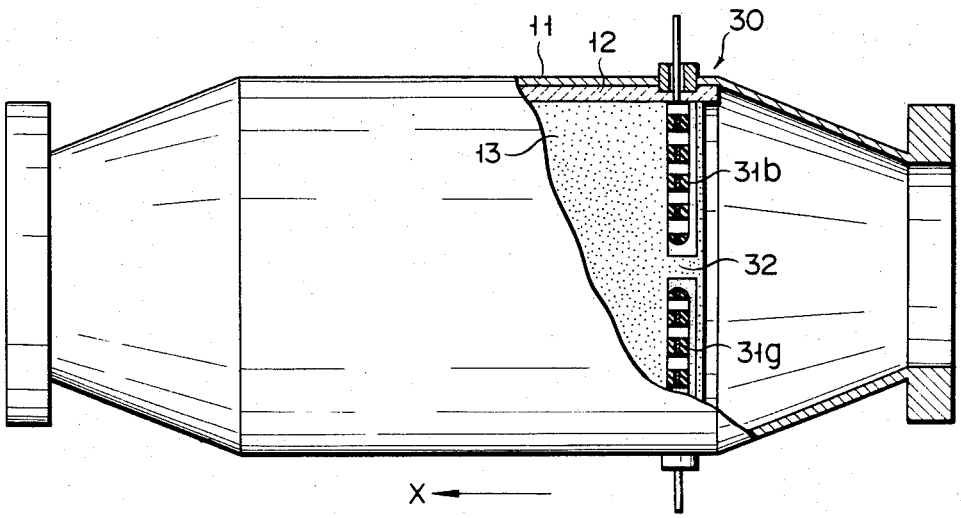
FIG. 5 is a partially broken front view showing another embodiment of the invention.

In the exhaust gas cleaning apparatus 30 according to this alternative embodiment, as shown in FIG. 5, a plurality of ceramic-coated electric heaters for regeneration—eight heaters 31*a*, 31*b*, 31*c*, 31*d*, 31*e*, 31*f*, 31*g* and 31*h* in this embodiment—are disposed at that end face portion of a filter 13 which is on the upstream side as viewed along the flowing direction X of the exhaust gas.

Figure 6:
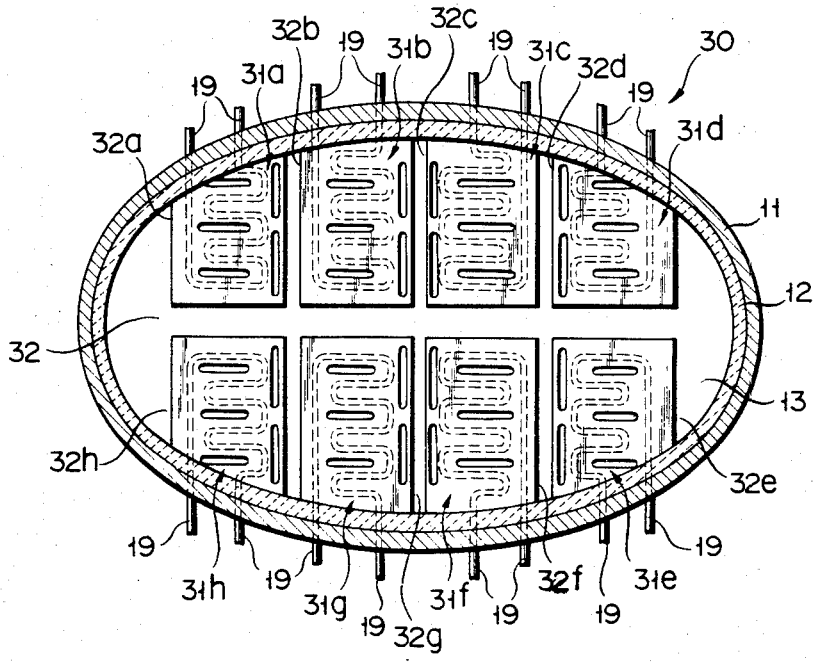
FIG. 6 is a side sectional view of the apparatus shown in FIG. 5.

In this case, as seen from FIG. 6, an exhaust gas passage face 32 of the upstream-side end face of the filter 13 is divided into, for example, eight passage sections 32*a*, 32*b*, 32*c*, 32*d*, 32*e*, 32*f*, 32*g* and 32*h*. The electric heaters 31*a* to 31*h* correspond to the passage sections 32*a* to 32*h*, respectively, in location. The eight electric heaters 31*a* to 31*h* are connected with control switches 16*a*, 16*b*, 16*c*, 16*d*, 16*e*, 16*f*, 16*g* and 16*h*, respectively. The control switches 16*a* to 16*h* are closed one after another by the drive control circuit 18. Thus, the electric heaters 31*a* to 31*h* are successively supplied with current.

Figure 7:
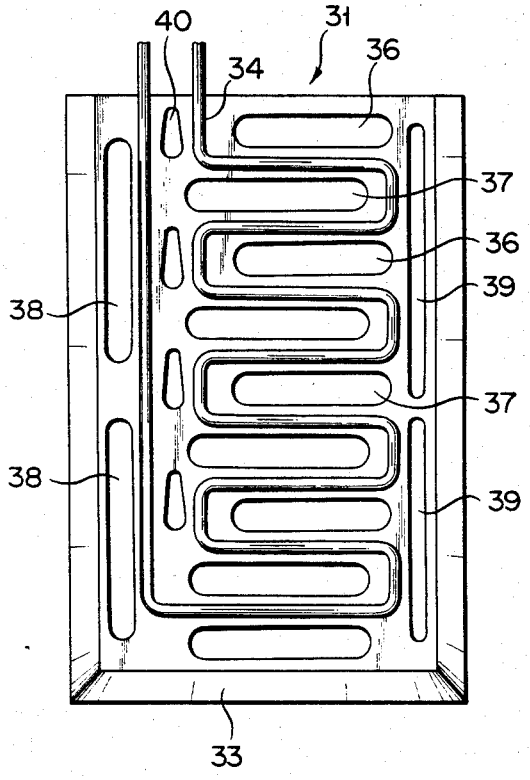
FIG. 7 is an isolated front view showing an electric heater used in the apparatus shown in FIG. 5.
Figure 8A:
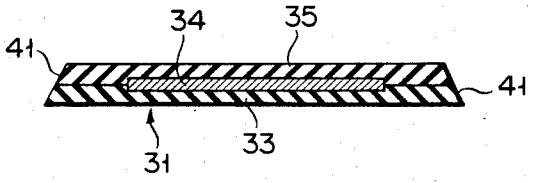
FIG. 8A is a sectional view of the electric heater shown in FIG. 7.

As shown in FIGS. 7 and 8A, each electric heater 31 (representative of the heaters 31*a* to 31*h*) comprises a ceramic sheet 33 formed of e.g. alumina, a heating resistance wire 34 formed by wavily laying paste containing molybdenum, tungsten or other heating metal on the ceramic sheet 33 by printing or other method, and another ceramic sheet 35 jointed to the ceramic sheet 33 with the heating resistance wire 34 between them. These sheets and wire form an integral structure. Namely, the electric heater 31 is formed by sandwiching the heating resistance wire 34 between the pair of ceramic sheets 33 and 35. A number of openings 36, 37, 38, 39 and 40 are bored through those portions of the ceramic sheets 33 and 35 which do not carry the wavy heating resistance wire 34.

Even though the electric heaters 31*a* to 31*h* are disposed on the exhaust gas passage face 32 of the filter 13, as shown in FIGS. 5 and 6, the exhaust gas is smoothly led into the filter 13 and discharged through the openings 36 to 40. To prevent increase of the exhaust passage resistance, the open area ratio should preferably be 30% or more.

The heating resistor may be formed by sandwiching a conventional ceramic heater formed of an SiC or $MoSi_2$ sheet between a pair of ceramic sheets made of alumina. Alternatively, the heating resistor may be formed from a mixture of TiC and $Al_2O_3$ with a suitable mixture ratio.

Figure 9A:
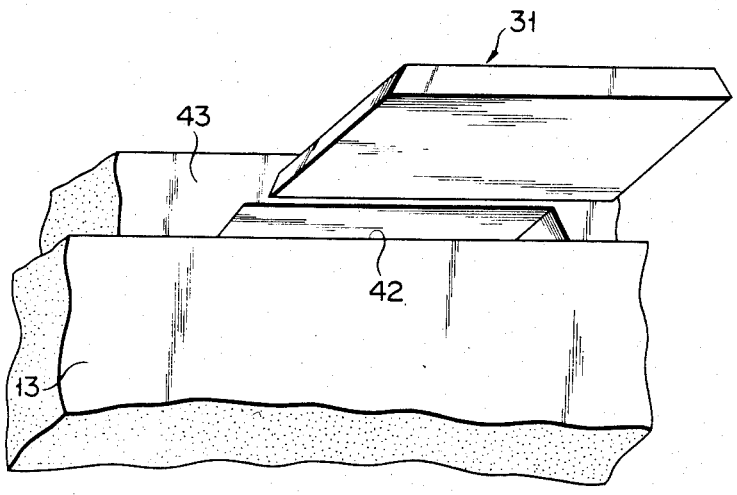
FIG. 9A is an isolated perspective view showing that portion of a filter which contains therein the electric heater shown in FIG. 8A.

As shown in FIG. 8A, both lateral faces 41 of each electric heater 31 are formed of slant surfaces so that the lower surface of the electric heater 31 is wider than the upper surfce. Thus, the electric heater 31 has a trapezoidal cross section. As shown in FIG. 9A, a mounting member 43 having a fitting slot 42 corresponding to the trapezoidal cross section is fixed to the upstream-side end face of the filter 13. Thus, the ceramic-coated electric heater 13 is inserted into the fitting slot 42 from the outer peripheral portio of the filter 13 so as to be set integrally with the filter 13.

Figure 8B:
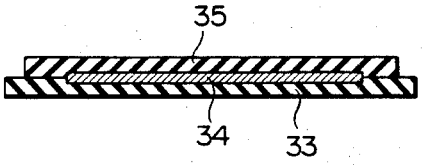
FIG. 8B is a sectional view showing a modification of the electric heater shown in FIG. 7.
Figure 9B:
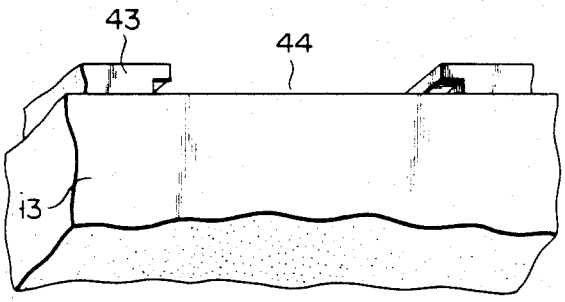
FIG. 9B is an isolated perspective view showing that portion of the filter which contains therein the electric heater shown in FIG. 8B.

As shown as a modification in FIGS. 8B and 9B, the electric heater may have stepped lateral faces so that its lower surface is wider than its upper surface. In this case, it is necessary only that the cross-sectional shape of a fitting groove 44 shown in FIG. 9B correspond to the stepped cross-sectional shape of the heater 31. Alternatively, the heater 31 may be set on the upstream-side end face of the filter 13 so that it is pressed and fixed by another filter member having a groove corresponding to the cross-sectional shape of the heater 31.

In short, it is necessary only that the ceramic-coated electric heater 31 (31*a* to 31*h*) and the ceramic filter 13 be joined together by insertion so that the heater 31 is fixed securely. This arrangement greatly facilitates and secures assembly work of the electric heaters.

The electric heater 31 (31*a* to 31*h*), which is fixed to the filter 13 in the aforementioned manner, can be made light enough to prevent breakage or other trouble even if it is set in the exhaust system of an engine and is subjected to vibration. Even though subjected to high-temperature exhaust gas or high temperature attributed to combustion of particulates, the heater can avoid thermal distortion which may result in breakage, since it is fixed by fitting. In the foregoing embodiment, the heater 31 has been described as being coupled directly to the filter 13. Alternatively, a buffer may be interposed between the filter 13 and the heater 31, or these two members may be fixed by using a heat-resisting adhesive agent tolerant of thermal distortion after they are jointed by insertion.

According to the embodiments of this invention, as described in detail herein, a plurality of ceramic-coated electric heaters are arranged on the upstream-side end face of a filter so that particulates caught by the filter may be burned by the heaters. Thus, the exhaust gas cleaning apparatus can enjoy high heat-oxidation-resisting and properties, and can be effectively used for cleaning exhaust gas from a Diesel engine. Even though the heater area is wide, openings in the heaters can maintain a sufficient exhaust gas passage area and reduce pressure loss. Moreover, gas flows near the heat source cause the particulates to stick to the heaters, thereby improving the efficiency of combustion for regeneration.

What we claim is:

1. An apparatus for cleaning exhaust gas discharged from a Diesel engine to the outside through an exhaust passage, comprising:

a hollow casing having a prescribed cross-sectional shape and opening at both ends, the inside space of the casing forming part of the exhaust passage;

a filter packed in the casing to catch particulates in the exhaust gas when the exhaust gas is passed through the filter;

ceramic heating resistors disposed in the casing on the upstream side of the filter with respect to the flow of the exhaust gas, and having passages through which the exhaust gas can pass, the ceramic heating resistors corresponding to a plurality of divided parts of the cross section of the inside space of the casing;

pairs of electrodes provided for the individual ceramic heating resistors, through which the corresponding ceramic heating resistors are energized; and energizing means connected to the electrodes for successively applying electric current between the individual pairs of electrodes to heat the ceramic heating resistors one after another, so that the heated ceramic heating resistors burn the particulates collected around the same.

2. The apparatus according to claim 1, wherein each said ceramic heating resistor is closely in contact with that end face of the filter which is on the upstream side with respect to the exhaust gas flow.

3. The apparatus according to claim 2, wherein said ceramic heating resistors are integral throughout the prescribed cross section of the inside space of the casing, and said pairs of electrodes are arranged individually at those sections of the ceramic heating resistor which correspond to said plurality of divided parts of the cross section.

4. The apparatus according to claim 3, wherein each said ceramic heating resistor is formed by extruding a compound containing silicon.

5. The apparatus according to claim 4, wherein each said ceramic heating resistor has the form of a lattice surrounding spaces which define said passages.

6. The apparatus according to claim 3, wherein each said electrode has a ceramic insulating member covering that portion of the electrode which is exposed to said exhaust gas passage.

7. The apparatus according to claim 1, wherein said ceramic heating resistor includes a plurality of resistor sections corresponding to said plurality of divided parts of the cross section.

8. The apparatus according to claim 7, wherein each said resistor section integrally includes first and second ceramic sheets and a heating resistance wire sandwiched between the two sheets and connected to each said pair of electrodes.

9. The apparatus according to claim 8, wherein each said resistor section is closely in contact with that end face of the filter which is on the upstream side with respect to the exhaust gas flow.

10. The apparatus according to claim 9, wherein said filter has a plurality of mounting members for fixing the resistor sections to said end face.

11. The apparatus according to claim 10, wherein each said mounting member has a slit in which its corresponding resistor section is inserted.

12. The apparatus according to claim 8, wherein said filter has a plurality of slits in which the individual resistor sections are inserted at that portion of the filter which is on the upstream side with respect to the exhaust gas flow.

13. The apparatus according to claim 12, wherein each said slit has a fitting groove having substantially the same cross-sectional shape as its corresponding resistor section.

14. The apparatus according to claim 1, wherein said energizing means includes a plurality of control switches for on-off control disposed between the individual electrodes and a power source, and a drive control device connected to the individual control switches to close the same one after another.

* * * * *